US007708340B2

(12) United States Patent
Tanizawa et al.

(10) Patent No.: US 7,708,340 B2
(45) Date of Patent: May 4, 2010

(54) MASSAGE CHAIR

(75) Inventors: Takayoshi Tanizawa, Higashiomi (JP); Satoshi Kajiyama, Hikone (JP); Masamichi Miyaguchi, Hikone (JP); Daisuke Tsukada, Hikone (JP); Fumihiro Nishio, Hikone (JP); Takeo Iijima, Hikone (JP); Yuichi Nishibori, Hikone (JP)

(73) Assignee: Panasonic Electric Works Co., Ltd., Kadoma-Shi (JP)

( * ) Notice: Subject to any disclaimer, the term of this patent is extended or adjusted under 35 U.S.C. 154(b) by 179 days.

(21) Appl. No.: 11/802,665

(22) Filed: May 24, 2007

(65) Prior Publication Data

US 2007/0273180 A1 Nov. 29, 2007

(30) Foreign Application Priority Data

May 26, 2006 (JP) ..... 2006-147390

(51) Int. Cl.
*A47C 31/00* (2006.01)

(52) U.S. Cl. ..... 297/217.3; 297/217.1; 297/411.2; 297/411.35; 297/DIG. 8; 601/99; 601/133

(58) Field of Classification Search ..... 297/217.3, 297/217.1, 284.1, 411.2, 411.35, DIG. 8; 601/99, 133, 84–93, 151
See application file for complete search history.

(56) References Cited

U.S. PATENT DOCUMENTS

| | | | | |
|---|---|---|---|---|
| 7,381,194 | B2 * | 6/2008 | Yoda et al. | 601/133 |
| 2006/0142676 | A1 * | 6/2006 | Fujii et al. | 601/98 |
| 2007/0273187 | A1 * | 11/2007 | Tanizawa et al. | 297/217.3 |

FOREIGN PATENT DOCUMENTS

| | | | |
|---|---|---|---|
| JP | 2005-013463 | | 1/2005 |
| JP | 2005-152260 | | 6/2005 |
| JP | 2005-177278 | | 7/2005 |
| JP | 2006087830 | A * | 4/2006 |
| JP | 2006204763 | A * | 8/2006 |

* cited by examiner

*Primary Examiner*—Laurie K Cranmer
(74) *Attorney, Agent, or Firm*—Edwards Angell Palmer & Dodge LLP

(57) ABSTRACT

A massage chair of the present invention includes an electric reclining mechanism for moving a backrest into different sloping positions, left and right holding mechanisms for respectively holding user's left and right forearms, and a controller for controlling operations of the mechanisms. The controller separately controls operations of the electric reclining mechanism and the left holding mechanism as well as operations of the electric reclining mechanism and the right holding mechanism. When controlling the former operations, the controller controls (A) allow the left holding mechanism to hold the left forearm, (B) allow the electric reclining mechanism to recline the backrest to any of the different sloping positions, (C) allow the electric reclining mechanism to raise the backrest to any of the different sloping positions, and (D) allow the left holding mechanism to release the left forearm. Similarly, the controller controls the latter operations.

4 Claims, 6 Drawing Sheets

MASSAGE CHAIR

TECHNICAL FIELD

The invention relates generally to massage chairs and more particularly to a massage chair that uses reclining movement of a backrest for stretching user's arms.

BACKGROUND ART

Such a massage machine is described in, for example, Japanese Patent Application Publication No. 2005-152260 issued Jun. 16, 2005. This machine (hereinafter referred to as a "first prior art") uses an electric reclining mechanism of a backrest to obtain a stretch (extension) effect on the user's arms and shoulders. That is, the first prior art swells upper and lower airbags located at each of left and right armrests to hold each hand and forearm of the user with each upper and lower airbags, and moves the backrest into an end position from a start position to lean the upper part of the user's body backward. The start position is a sloping position, and the end position is a sloping position that has an inclination larger than the start position with respect to the vertical direction. In case of a first operational example, the first prior art moves the backrest into the end position while swelling the airbags of the armrests; returns the backrest to the start position after the airbags finish swelling; and shrinks the airbags after holding each swell condition of the airbags for a specified time. In case of a second operational example, the first prior art swells the airbags of the armrests; moves the backrest into the end position after the airbags finish swelling; and returns the backrest to the start position while shrinking the airbags after holding each swell condition of the airbags for a specified time. However, in this first prior art, there is an issue that the two sets of upper and lower airbags restrain the user's arms simultaneously.

Another massage machine described in Japanese Patent Application Publication No. 2005-177278 issued Jul. 7, 2005 can solve the issue. This massage machine (hereinafter referred to as a "second prior art") also swells upper and lower airbags located at each of left and right armrests to hold each hand and forearm of the user with each upper and lower airbags, and moves the backrest into an end position from a start position to lean the upper part of the user's body backward. At this point, the second prior art adjusts holding strength by upper and lower airbags located at one of the left and right armrests so that the user can take the corresponding arm off the upper and lower airbags. Therefore, the second prior art can prevent two sets of upper and lower airbags from restraining the user's arms simultaneously.

However, the second prior art decreases holding strength by upper and lower airbags located at one of the left and right armrests and accordingly cannot hold the user's corresponding hand and forearm surely.

DISCLOSURE OF THE INVENTION

It is an object of the present invention to use reclining movement of a backrest for stretching the user's arms not to restrain the arms simultaneously, without adjusting holding strength by one of left and right holding mechanisms so that the user can take the corresponding arm off the one of left and right holding mechanisms.

A massage chair of the present invention comprises a base, a reclining backrest, an electric reclining mechanism, a left holding mechanism, a right holding mechanism and a controller. The base includes a seat. The reclining backrest is located at the back of the base. The electric reclining mechanism is configured to move the backrest into different sloping positions. The left holding mechanism is configured to hold at least left forearm of a user to fix the at least left forearm to the base side. The right holding mechanism is configured to hold at least right forearm of the user to fix the at least right forearm to the base side. The controller is configured to control operations of the electric reclining mechanism and the left and right holding mechanisms. According to an aspect of the invention, the controller separately controls operations of the electric reclining mechanism and the left holding mechanism as well as operations of the electric reclining mechanism and the right holding mechanism. When controlling operations of the electric reclining mechanism and the left holding mechanism, the controller controls (A) allow the left holding mechanism to hold the at least left forearm, (B) allow the electric reclining mechanism to recline the backrest to any of the different sloping positions, (C) allow the electric reclining mechanism to raise the backrest to any of the different sloping positions, and (D) allow the left holding mechanism to release the at least left forearm. When controlling operations of the electric reclining mechanism and the right holding mechanism, the controller controls (a) allow the right holding mechanism to hold the at least right forearm, (b) allow the electric reclining mechanism to recline the backrest to any of the different sloping positions, (c) allow the electric reclining mechanism to raise the backrest to any of the different sloping positions, and (d) allow the right holding mechanism to release the at least right forearm.

In this invention, one side of the user's arms and shoulder is stretched and then released, and afterwards the other side is stretched and then released. Accordingly, it is possible to use reclining movement of the backrest for stretching the user's arms and shoulders not to restrain the arms simultaneously, without adjusting holding strength by one of the left and right holding mechanisms so that the user can take the corresponding arm off the one of left and right holding mechanisms.

In a preferred embodiment, the massage chair further comprises left and right armrests. The left holding mechanism comprises: a left cover that is located above the left armrest and covers the at least left forearm; at least one first airbag located at the left armrest and/or the left cover; and an air supply pump for swelling the first airbag. The right holding mechanism comprises: a right cover that is located above the right armrest and covers the at least right forearm; at least one second airbag located at the right armrest and/or the right cover; and said or another air supply pump for swelling the second airbag. When holding the at least left forearm, the controller controls to swell the first airbag through the air supply pump of the left holding mechanism to hold the at least left forearm with the first airbag, the left armrest and the left cover. When holding the at least right forearm, the controller controls to swell the second airbag through the air supply pump of the right holding mechanism to hold the at least right forearm with the second airbag, the right armrest and the right cover. In this construction, it is possible to hold the at least left and right forearms elastically with the first and second airbags, respectively. Moreover, this invention can prevent the left and right holding mechanisms from putting stress on the user's left and right forearms in a stretching operation of the at least left and right forearms, respectively.

Preferably, in case that a sloping position of the backrest has an inclination larger than a reference sloping position of the different sloping positions with respect to the vertical direction, the controller controls to allow the electric reclining mechanism to raise the backrest to the reference sloping position before allowing any of the left and right holding mechanisms to hold the corresponding at least forearm of the user. This invention can stretch the user's arms and shoulders with sufficient strength.

In another preferred embodiment, the controller controls to increase holding force by the first airbag as allowing the electric reclining mechanism to recline the backrest after holding the at least left forearm with the first airbag, the left armrest and the left cover. The controller also controls to increase holding force by the second airbag as allowing the electric reclining mechanism to recline the backrest after holding the at least right forearm with the second airbag, the right armrest and the right cover. In this construction, the at least left and right forearms can be held properly with the first and second airbags, respectively, without applying excessive force during a stretching operation each of them.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1:
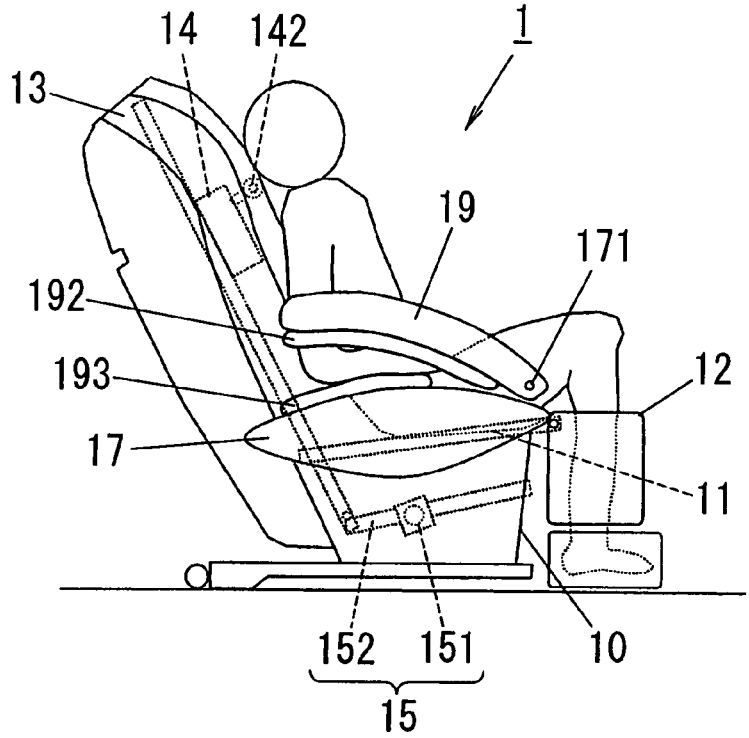
FIG. 1 is a schematic diagram of an embodiment according to the present invention seen from the right side.
Figure 2:
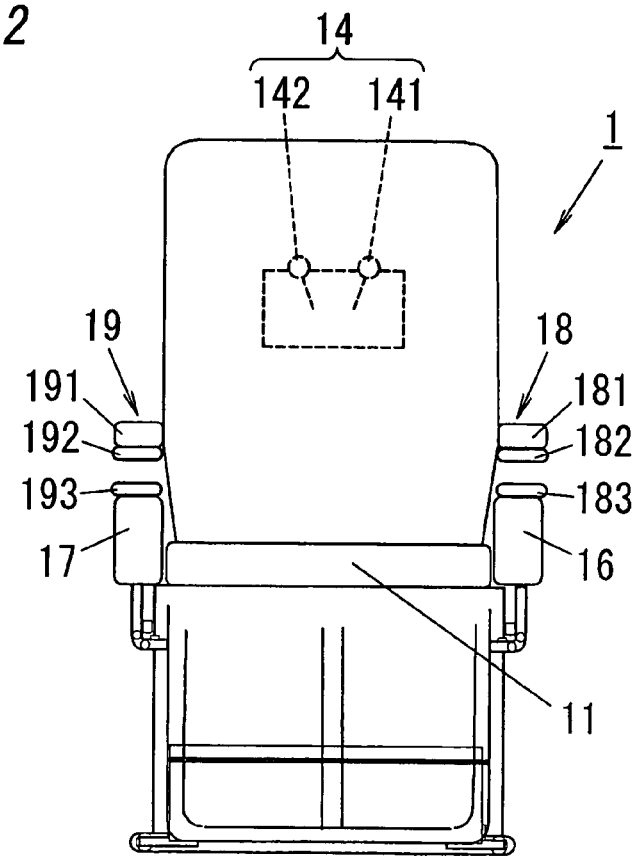
FIG. 2 is a schematic diagram of the embodiment seen from the front side.
Figure 3:
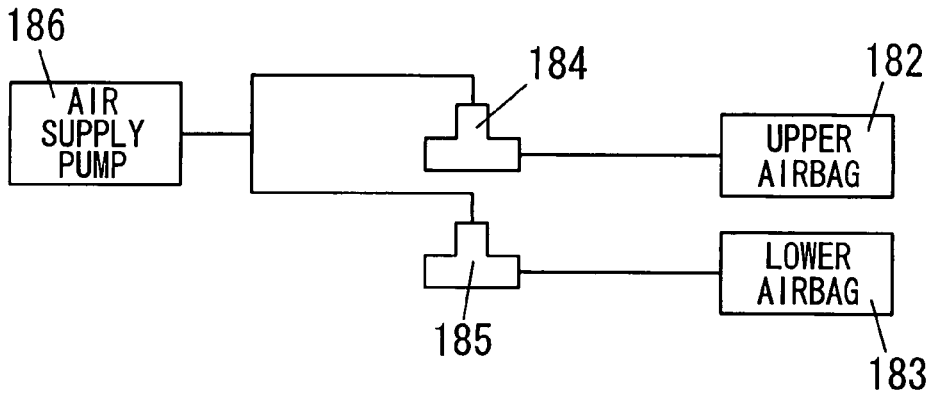
FIG. 3 is an explanatory diagram of a left holding mechanism in the embodiment.
Figure 4:
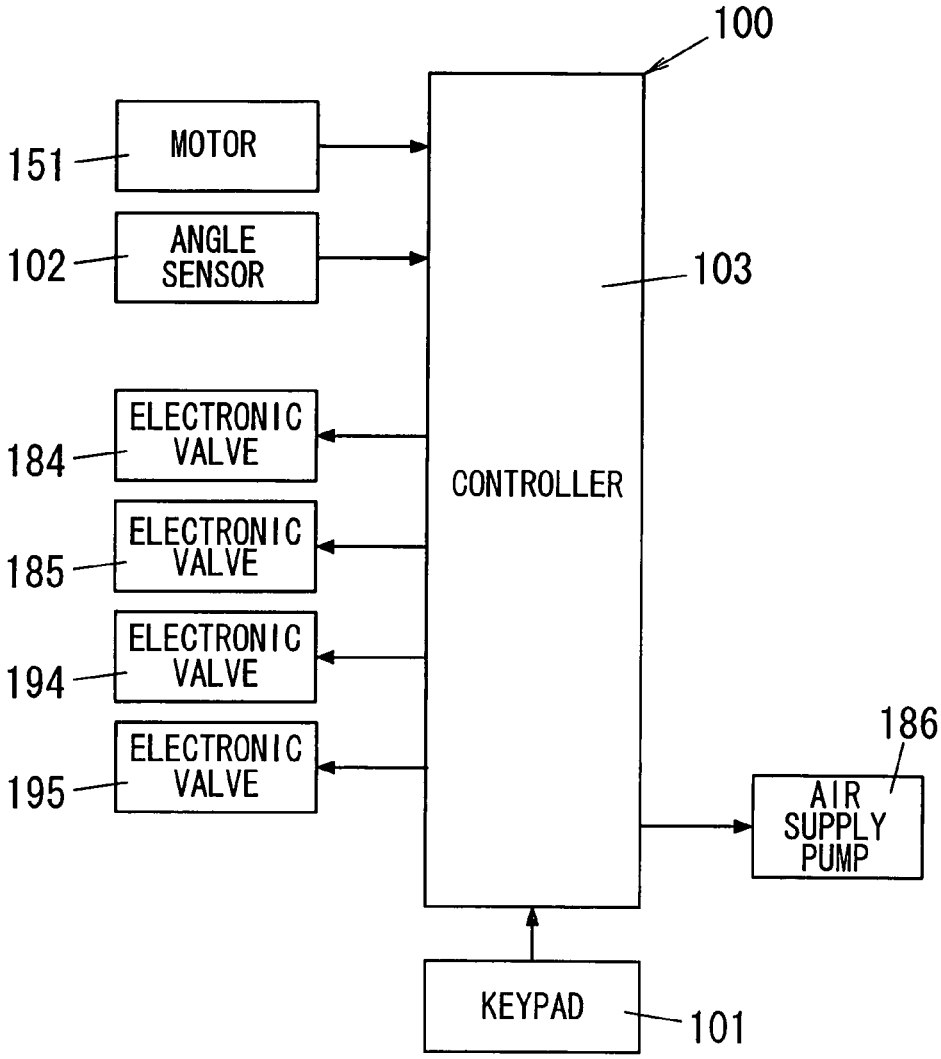
FIG. 4 is a block diagram of a drive system in the embodiment.

FIGS. 1 and 2 show an embodiment according to the present invention, namely a massage chair 1. For example, this chair 1 comprises a base 10, a leg/foot rest 12, a reclining backrest 13, a massage mechanism 14, an electric reclining mechanism 15, left and right armrests 16 and 17, left and right holding mechanisms 18 and 19, and a drive system 100 (see FIG. 4). The base 10 includes a seat 11. The leg/foot rest 12 is configured so as to be supported by at least one axis fixed to the base 10 to rise and fall by rotating about the axis through an electric elevating mechanism (not shown) put in the base 10. This mechanism is well known to those skilled in the art and therefore is not described in detail herein.

The backrest 13 is located at the back of the base 10 and can be reclined to different sloping positions such as sitting position, full reclining position and so on through the electric reclining mechanism 15 constructed of a motor 151 and a link mechanism 152 in the same way as conventional massage chairs. In this embodiment, the backrest 13 can be reclined to any of eight sloping positions equally divided in the reclining direction. The massage mechanism 14 is an elevating massage mechanism located in the backrest 13, and has left and right massage heads (e.g., kneading balls) 141 and 142 that simulate massage movement (e.g., kneading and tapping) to give a user a massage in accordance with control of the drive system 100. In general, the massage mechanism 14 is driven after the backrest 13 is moved into a desired sloping position through a sloping-position adjusting key (not shown).

As shown in FIGS. 1-4, the left and right armrests 16 and 17 are installed at the left and right sides of the base 10 and are provided with the left and right holding mechanisms 18 and 19, respectively. The left holding mechanism 18 includes a left cover 181, upper and lower airbags (first airbags) 182 and 183, electronic valves 184 and 185, and an air supply pump 186. The cover 181 is formed so as to cover at least left forearm of a user. In this embodiment, the cover 181 is formed to cover the user's left hand and forearm, and is supported by an axis fixed to the front of the left armrest 16 to move upward and downward in the upside of the armrest 16 by rotating about the axis. In addition, for example, by an electric mechanism (not shown), the cover 181 can be moved into a predetermined angle in a specified range and then be locked. The airbag 182 is installed on the bottom face of the cover 181 and is coupled to the pump 186 or the atmosphere through the electronic valve 184, while the airbag 183 is installed on the top face of the armrest 16 and is coupled to the pump 186 or the atmosphere through the electronic valve 185. The electronic valve 184 is driven by the drive system 100 to couple the airbag 182 to the pump 186 and the atmosphere in case of air supply and exhaust, respectively. The electronic valve 185 is also driven by the drive system 100 to couple the airbag 183 to the pump 186 and the atmosphere in case of air supply and exhaust, respectively. The pump 186 is driven by the drive system 100.

Similarly, the right holding mechanism 19 includes a right cover 191, upper and lower airbags (second airbags) 192 and 193, electronic valves 194 and 195, and the air supply pump 186. However, not limited to this, the right holding mechanism 19 may comprise another air supply pump instead of the pump 186. Each airbag of the left and right holding mechanisms 18 and 19 is formed from flexible materials and has airtightness. The cover 191 is formed so as to cover at least right forearm of a user. In the embodiment, the cover 191 is formed to cover the user's right hand and forearm, and is supported by an axis 171 fixed to the front of the right armrest 17 to move upward and downward in the upside of the armrest 17 by rotating about the axis 171. In addition, for example, by an electric mechanism (not shown), the cover 191 can be moved into a predetermined angle in a specified range and then be locked. However, not limited to these, the covers 181 and 191 may be fixed to the left and right armrests 16 and 17 at a predetermined angle, respectively. The airbag 192 is installed on the bottom face of the cover 191 and is coupled to the pump 186 or the atmosphere through the electronic valve 194, while the airbag 193 is installed on the top face of the armrest 17 and is coupled to the pump 186 or the atmosphere through the electronic valve 195. The electronic valve 194 is driven by the drive system 100 to couple the airbag 192 to the pump 186 and the atmosphere in case of air supply and exhaust, respectively. The electronic valve 195 is also driven by the drive system 100 to couple the airbag 193 to the pump 186 and the atmosphere in case of air supply and exhaust, respectively.

Figure 5:
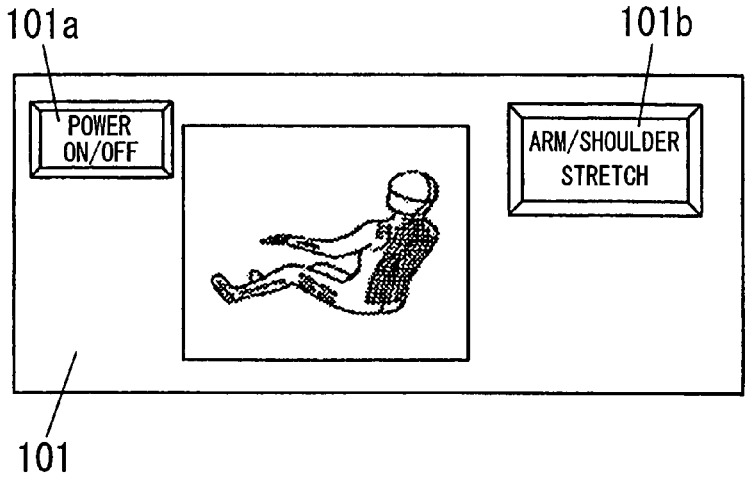
FIG. 5 is an explanatory diagram of a keypad in the embodiment.

The drive system 100 comprises a keypad 101 as an input means, an angle sensor 102, a controller 103 and so on. As shown in FIG. 5, the keypad 101 comprises various keys such as a power on/off key 101*a*, an arm/shoulder stretch key 101*b* and so on in addition to the above sloping-position adjusting key. The angle sensor 102 is configured to detect the angle of a sloping position of the backrest 13. The controller 103 is, for example, constructed of one or more microcomputers, a storage device and so on, and has various programs, data on angles of the different sloping positions and so on. This controller 103 controls operations of different mechanisms based on different instructions obtained from the keypad 101, detection result of the angle sensor 102 and so on. The different mechanisms include the electric elevating mechanism of the leg/foot rest 12, the elevating massage mechanism, the electric reclining mechanism 15, the left and right holding mechanisms 18 and 19 and so on.

In addition to various controls executed in the same way as conventional massage chairs, the controller 103 provides the control for stretching the user's arms and shoulders according to an aspect of the embodiment when the key 101*b* is pressed after switch-on by pressing the key 101*a*. That is, the controller 103 controls to move the covers 181 and 191 into the predetermined angle to lock the covers 181 and 191 through the electric mechanisms of the left and right holding mechanisms 18 and 19, respectively. Afterwards, the controller 103 provides the control for stretching the user's left arm and shoulder and the control for stretching the right arm and shoulder separately (e.g., alternately). The both controls constitute a stretching operation of the arms and shoulders.

Expanding on this stretching operation, for example, the controller 103 controls to swell the airbags 182 and 183 through the electronic valves 184 and 185 and the pump 186 to hold the left hand and forearm elastically with the airbags 182 and 183. That is, the controller 103 controls to allow the left holding mechanism 18 to hold the left hand and forearm. The controller 103 then controls to allow the electric reclining mechanism 15 to recline the backrest 13 from a start position to an end position based on detection result of the angle sensor 102. At this point, the controller 103 dives the motor 151 so that the detection result agrees with the angle of an objective sloping position stored in the storage device of the controller 103. The start and end positions are included in the above different sloping positions, and the end position has an inclination larger than the start position with respect to the vertical direction. The controller 103 also controls to increase holding force by the first airbags as allowing the electric reclining mechanism 15 to move the backrest 13 from the start position to the end position. The controller 103 then controls to allow the electric reclining mechanism 15 to raise the backrest 13 from the end position to a return position based on detection result of the angle sensor 102. The return position is included in the different sloping positions, and has an inclination smaller than the end position with respect to the vertical direction. In the embodiment, the return position is same as the start position. The controller 103 controls to shrink the airbags 182 and 183 through the electronic valves 184 and 185 and the pump 186 to release the left hand and forearm. That is, the controller 103 controls to allow the left holding mechanism 18 to release the left hand and forearm.

Similarly, the controller 103 controls to allow the right holding mechanism 19 to hold the right hand and forearm. The controller 103 then controls to allow the electric reclining mechanism 15 to move the backrest 13 from a start position to an end position and afterwards from the end position to a return position based on detection result of the angle sensor 102. The controller 103 also controls to increase holding force by the second airbags as allowing the electric reclining mechanism 15 to move the backrest 13 from the start position to the end position. The controller 103 then controls to allow the right holding mechanism 19 to release the right hand and forearm.

The controller 103 also utilizes the airbags 182, 183, 192 and 193 as massage means. In this case, the controller 103 swells and shrinks at least one of the airbags 182, 183, 192 and 193 while driving the pump 186.

Figure 6:
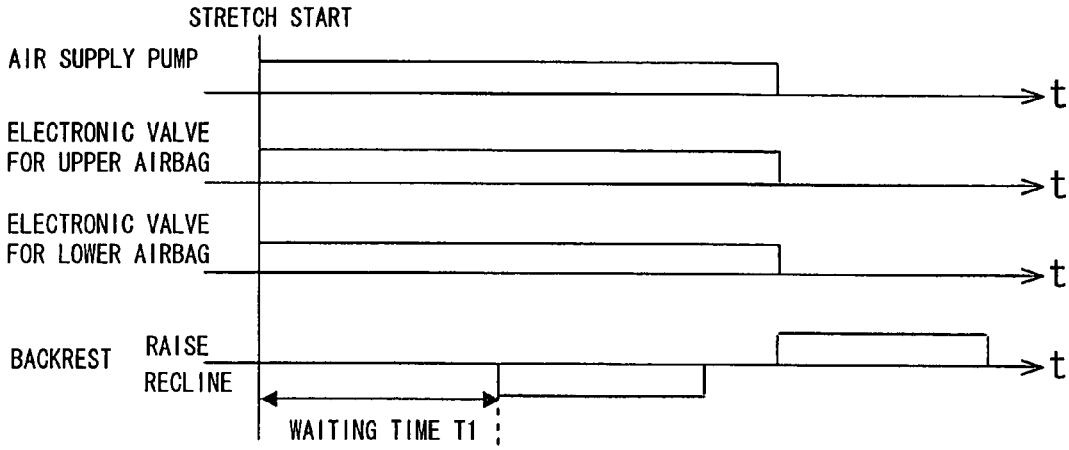
FIG. 6 is a time chart of a stretching operation of the embodiment.

The operation of the massage chair 1 is now explained with reference to FIG. 6, as follows. When the key 101*b* is pressed after switch-on by pressing the key 101*a*, the controller 103 moves the covers 181 and 191 into the predetermined angle to lock the covers 181 and 191 through the electric mechanisms of the left and right holding mechanisms 18 and 19, and then starts and repeats the stretching operation.

In each stretching operation, first, the controller 103 provides the control for stretching the user's left arm and shoulder or the control for stretching the right arm and shoulder. For example, the controller 103 swells the airbags 182 and 183 through the electronic valves 184 and 185 and the pump 186. At this point, the controller 103 drives the electronic valves 184 and 185 to couple the airbags 182 and 183 to the pump 186, and also drives the pump 186. After a waiting time T1, the controller 103 moves the backrest 13 into an end position from a start position at a constant speed through the electric reclining mechanism 15. The time T1 is set to a time necessary to hold one hand and forearm surely with the corresponding airbags. After few seconds from a point in time at which the backrest 13 reaches the end position, the controller 103 shrinks the airbags 182 and 183 through the electronic valves 184 and 185 and the pump 186. At this point, the controller 103 drives the electronic valves 184 and 185 to couple the airbags 182 and 183 to the atmosphere, and also stops the pump 186. The controller 103 also starts moving the backrest 13 into a return position from the end position at a constant speed through the electric reclining mechanism 15.

After (or immediately after) the backrest 13 reaches the return position, the controller 103 swells the airbags 192 and 193 through the electronic valves 194 and 195 and the pump 186. At this point, the controller 103 drives the electronic valves 194 and 195 to couple the airbags 192 and 193 to the pump 186, and also drives the pump 186. After a waiting time T1, the controller 103 moves the backrest 13 into an end position from a start position at a constant speed through the electric reclining mechanism 15. After few seconds from a point in time at which the backrest 13 reaches the end position, the controller 103 shrinks the airbags 192 and 193 through the electronic valves 194 and 195 and the pump 186. At this point, the controller 103 drives the electronic valves 194 and 195 to couple the airbags 192 and 193 to the atmosphere, and also stops the pump 186. The controller 103 also starts moving the backrest 13 into a return position from the end position at a constant speed through the electric reclining mechanism 15. When the backrest 13 reaches the return position, one stretching operation of the user's arms and shoulders is completed. However, not limited to this stretching operation, the controller of the present invention may control to stretch the user's left (or right) arm and shoulder once or more, and then stretch the right (or left) arm and shoulder once or more.

In this embodiment, one side of the user's arms and shoulders is stretched and then released, and afterwards the other side is stretched and then released. Accordingly, it is possible to use reclining movement of a backrest for stretching the user's arms not to restrain the arms simultaneously, without adjusting holding strength by one of left and right holding mechanisms so that the user can take the corresponding arm off the one of left and right holding mechanisms. In addition, since one of the user's arms is always free, the user can operate the keypad 101 during a stretching operation. Also, since the backrest 13 is kept at an end position for few seconds, a preferable stretch effect can be obtained. Moreover, after holding one hand and forearm of the user surely with the corresponding airbags, the controller 103 controls to increase holding force by the corresponding airbags as allowing the electric reclining mechanism 15 to move the backrest 13 into an end position from a start position. Accordingly, the left and right hands and forearms can be held properly with the first and second airbags, respectively, without applying excessive force during a stretching operation.

Figure 7A:
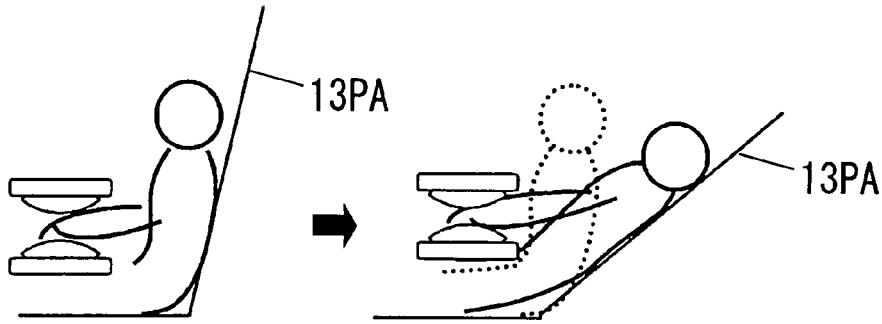
FIGS. 7A and 7B are explanatory diagrams of an issue to be solved in the embodiment.
Figure 7B:
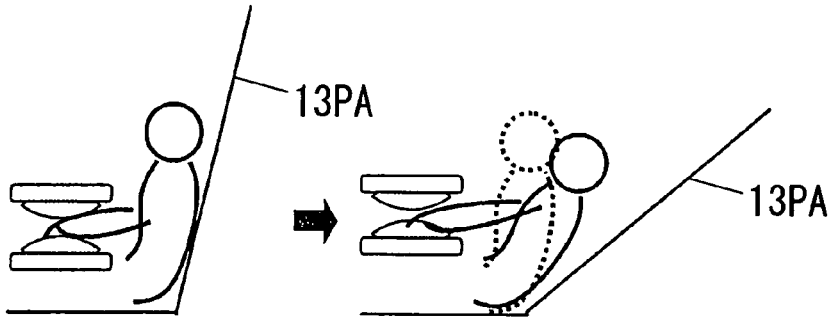
Figure 8:
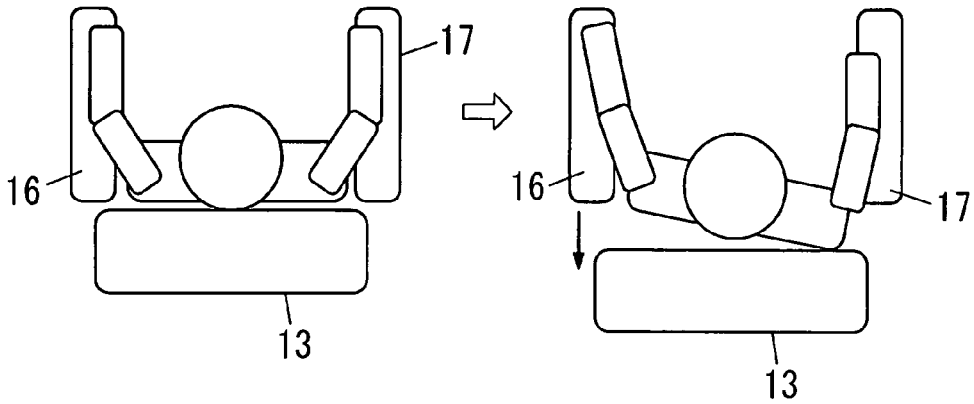
FIG. 8 is explanatory diagrams of an advantage of the embodiment.

Expanding on other advantages of this embodiment, the massage chair 1 can be prevented from pulling the user's arms strongly in a stretching operation. In case that the user's arms are comparatively long as shown in FIG. 7A, the first or second prior art can always support the upper part of the body by its backrest 13PA in a stretching operation of the arms. However, in case that the user's arms are comparatively short as shown in FIG. 7B, the backrest 13PA cannot always support the upper part of the body in a stretching operation. As a result, since the upper part of the body is completely apart from the backrest 13PA, the arms are pulled strongly. In this embodiment, even if the user's arms are comparatively short as shown in an example of FIG. 8, one side (e.g., right side) of the upper part of the body is supported by the backrest 13 when the opposite arm (e.g., left arm) is stretched, and accordingly the massage chair 1 can be prevented from pulling the user's arms strongly.

Figure 9A:
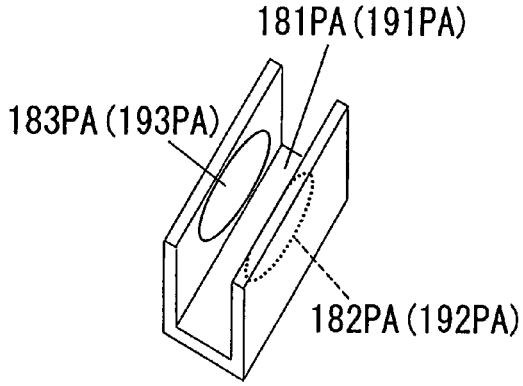
FIGS. 9A and 9B are explanatory diagrams of an advantage of the embodiment.
Figure 9B:
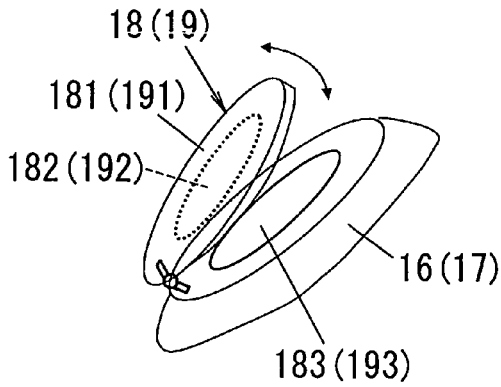

In addition, the left and right holding mechanisms 18 and 19 can be prevented from putting stress on the user's left and right forearms in a stretching operation, respectively. For example, a massage machine described in Japanese Patent Application Publication No. 2005-013463 issued Jan. 20, 2005 comprises left and right holding mechanisms located at left and right armrests, respectively. As shown in FIG. 9A, each of the holding mechanisms comprises a U-shaped supporter 181PA (or 191PA), and left and right airbags 182PA and 183PA (or 192PA and 193PA) installed inside the supporter. In such holding mechanisms, when the user's arms are stretched simultaneously, the supporters 181PA and 191PA interfere with movement of the user's left and right forearms to put stress on the left and right forearms, respectively. In the embodiment, the upper and lower airbags 182 and 183 are respectively installed at the cover 181 and the armrest 16 as shown in FIG. 9B. The upper and lower airbags 192 and 193 are also installed at the cover 191 and the armrest 17, respectively. Accordingly, since the covers 181 and 191 do not interfere with movement of the user's left and right forearms, the holding mechanisms 18 and 19 can be prevented from putting stress on the left and right forearms.

In a modified embodiment, the controller 103 is configured to swell one of the airbags 182 and 183 when holding the user's left hand and forearm, and also swell one of the airbags 192 and 193 when holding the right hand and forearm. However, not limited to this, the left mechanism 18 may be provided with an upper or lower airbag and a lower or upper cushion instead of the airbags 182 and 183, and also the right mechanism 19 may be provided with an upper or lower airbag and a lower or upper cushion instead of the airbags 192 and 193. In short, the left holding mechanism of the present invention may comprise: a left cover that is located above the left armrest 16 and covers at least the left forearm of a user; at least one first airbag located at the left armrest and/or the left cover; and an air supply pump for swelling the first airbag. Similarly, the right holding mechanism of the present invention may comprise: a right cover that is located above the right armrest 17 and covers at least the right forearm of the user; at least one second airbag located at the right armrest and/or the right cover; and said or another air supply pump for swelling the second airbag.

Figure 11:
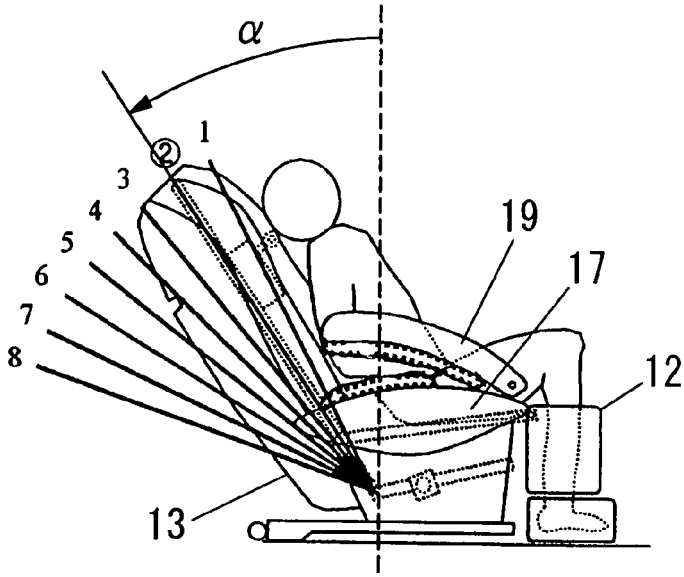
FIG. 11 is an explanatory diagram of the stretching operation.
Figure 12A:
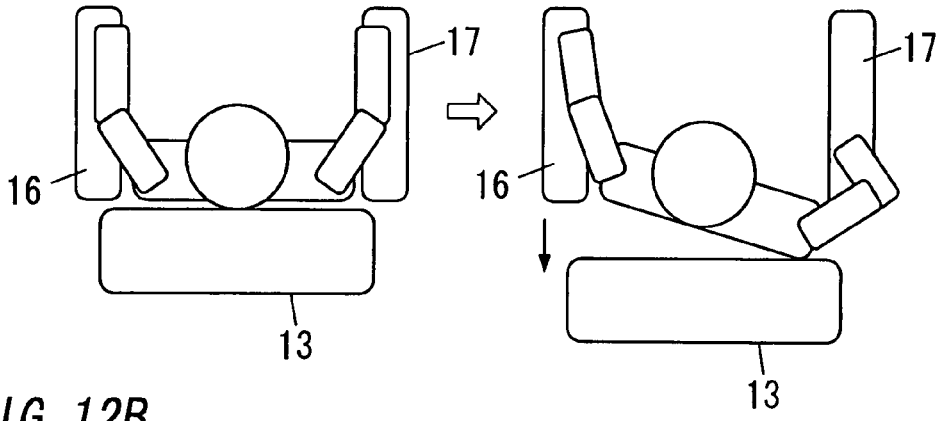
FIGS. 12A and 12B are explanatory diagrams of a preliminary operation in the preferred embodiment.
Figure 12B:
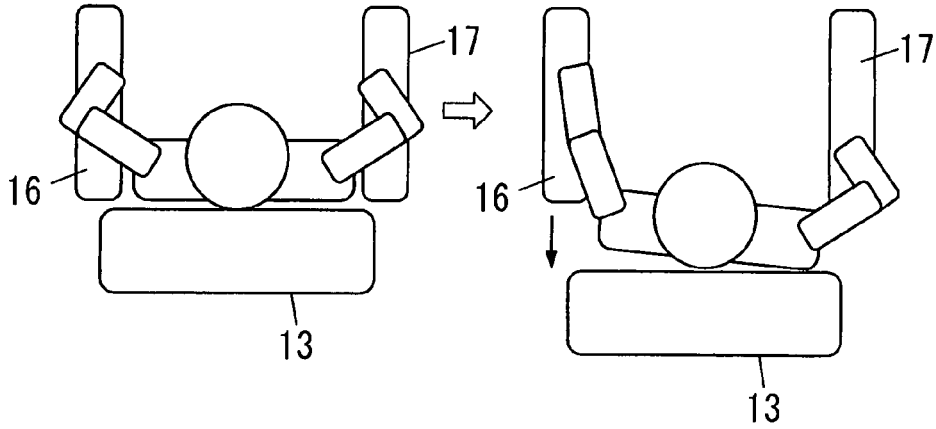

In a preferred embodiment, when a sloping position of the backrest 13 has an inclination larger than a reference sloping position of the above different sloping positions with respect to the vertical direction, the controller 103 controls to allow the electric reclining mechanism 15 to raise the backrest 13 to the reference sloping position before allowing any of the left and right holding mechanisms 18 and 19 to hold the corresponding at least forearm of the user. The operation of this control is hereinafter referred to as a "preliminary operation" (see FIG. 10). The different sloping positions are eight sloping positions equally divided in the reclining direction as shown in an example of FIG. 11, and the reference sloping position is, for example, the second sloping position 2 from the vertical direction and has an inclination $\alpha$. The stretch strength on the user's left arm depends on the position of the left hand put on the armrest 16, and the stretch strength on the right arm also depends on the position of the right hand put on the armrest 17. For example, as shown in FIG. 12A, in case that the user's left and right hands are deeply inserted into the left and right holding mechanisms 18 and 19, the stretch strength on the arms is increased. As shown in FIG. 12B, in case that the left and right hands are slightly inserted into the holding mechanisms 18 and 19, the stretch strength on the arms is decreased. In this preferred embodiment, when a sloping position of the backrest 13 has an inclination larger than the reference sloping position, the controller 103 provides the control for the preliminary operation so that the user's left and right hands are deeply inserted into the left and right holding mechanisms 18 and 19, respectively. Preferably, the inclination $\alpha$ is set to, for example, 30° or less, and is stored in the storage device of the controller 103.

Figure 10:
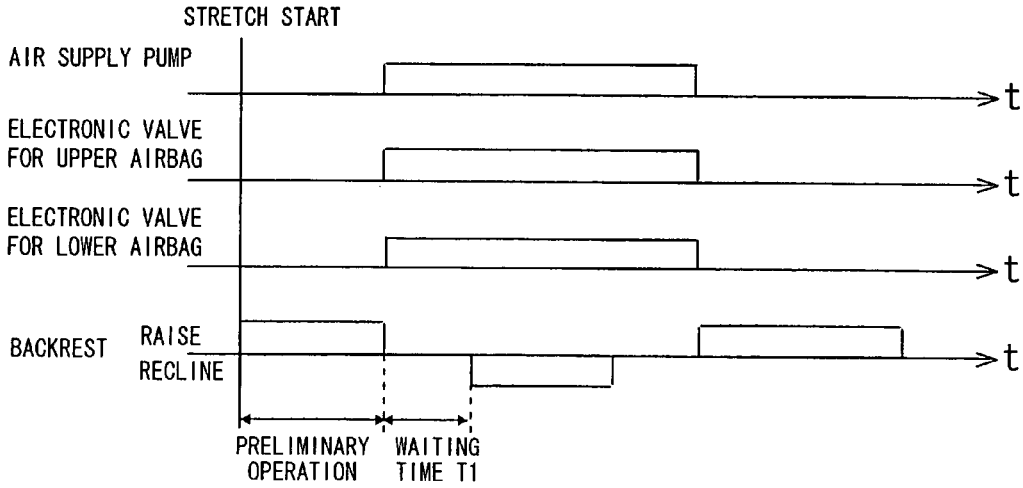
FIG. 10 is a time chart of a stretching operation of a preferred embodiment.

The operation of this preferred embodiment is now explained. In each stretching operation, when a sloping position of the backrest 13 has an inclination larger than the reference sloping position, the controller 103 performs the control for the preliminary operation based on detection result of the angle sensor 102 as shown in FIG. 10. At this point, the controller 103 drives the electric reclining mechanism 15 so that detection result of the angle sensor 102 agrees with the angle of the reference sloping position. Afterwards, the controller 103 provides the control for stretching the user's left arm and shoulder or the control for stretching the right arm and shoulder. This preferred embodiment can stretch the user's arms and shoulders with sufficient strength.

In another modified embodiment, the controller 103 is configured to stop the pump 186 immediately after the backrest 13 reaches an end position and, after few seconds, drive the corresponding electronic valves to couple the corresponding airbags to the atmosphere. In this construction, immediately after the backrest 13 reaches an end position, increase of holding force by the corresponding airbags can be stopped, and holding force when the backrest 13 reaches the end position can be kept for few seconds.

Although the present invention has been described with reference to certain preferred embodiments, numerous modifications and variations can be made by those skilled in the art without departing from the true spirit and scope of this invention.

The invention claimed is:

1. A massage chair, comprising:

a base including a seat;

a reclining backrest located at the back of the base;

right and left armrests fixed to the base;

an electric reclining mechanism for moving the backrest into different sloping positions;

a left holding mechanism for holding at least a left forearm of a user to restrain the at least left forearm to the left armrest;

a right holding mechanism for holding at least a right forearm of the user to restrain the at least right forearm to the right armrest; and a controller that controls operations of the electric reclining mechanism and the left and right holding mechanisms;

wherein the controller separately controls operations of the electric reclining mechanism and the left holding mechanism as well as operations of the electric reclining mechanism and the right holding mechanism, wherein:

when controlling operations of the electric reclining mechanism and the left holding mechanism, the controller controls (A) to allow the left holding mechanism to hold the at least left forearm to the left armrest in a fixed position, (B) to allow the electric reclining mechanism to recline the backrest to any of the different sloping positions, (C) to allow the electric reclining mechanism to raise the backrest to any of the different sloping positions, and (D) to allow the left holding mechanism to release the at least left forearm; and when controlling operations of the electric reclining mechanism and the right holding mechanism, the controller controls (a) to allow the right holding mechanism to hold the at least right forearm to the right armrest in a fixed position, (b) to allow the electric reclining mechanism to recline the backrest to any of the different sloping positions, (c) to allow the electric reclining mechanism to raise the backrest to any of the different sloping positions and (d) to allow the right holding mechanism to release the at least right forearm.

2. The massage chair of claim 1, wherein the left holding mechanism comprises: a left cover that is located above the left armrest and covers the at least left forearm;

at least one first airbag located at the left armrest and/or the left cover; and and an air supply pump for swelling the first airbag;

wherein the right holding mechanism comprises: a right cover that is located above the right armrest and covers the at least right forearm;

at least one second airbag located at the right armrest and/or the right cover;

and said or another air supply pump for swelling the second airbag;

wherein the controller controls to: swell the first airbag through the air supply pump of the left holding mechanism to hold the at least left forearm with the first airbag, the left armrest and the left cover when holding the at least left forearm; and also swell the second airbag through the air supply pump of the right holding mechanism to hold the at least right forearm with the second airbag, the right armrest and the right cover when holding the at least right forearm.

3. The massage chair of claim 2, wherein the controller controls to: increase holding force by the first airbag as allowing the electric reclining mechanism to recline the backrest after holding the at least left forearm with the first airbag, the left armrest and the left cover;

and also increase holding force by the second airbag as allowing the electric reclining mechanism to recline the backrest after holding the at least right forearm with the second airbag, the right armrest and the right cover.

4. The massage chair of claim 1, wherein in case that a sloping position of the backrest has an inclination larger than a reference sloping position of the different sloping positions with respect to a vertical direction, the controller controls to allow the electric reclining mechanism to raise the backrest to the reference sloping position before allowing any of the left and right holding mechanisms to hold the corresponding at least forearm of the user.

* * * * *